US010244870B1

(12) United States Patent
Bobst

(10) Patent No.: US 10,244,870 B1
(45) Date of Patent: Apr. 2, 2019

(54) GAMING CHAIR

(71) Applicant: Joel Bobst, Lecanto, FL (US)

(72) Inventor: Joel Bobst, Lecanto, FL (US)

( * ) Notice: Subject to any disclaimer, the term of this patent is extended or adjusted under 35 U.S.C. 154(b) by 149 days.

(21) Appl. No.: 15/367,574

(22) Filed: Dec. 2, 2016

(51) Int. Cl.

| | |
|---|---|
| ***A47C 7/62*** | (2006.01) |
| ***A47C 3/18*** | (2006.01) |
| ***A47C 1/00*** | (2006.01) |
| ***A47C 7/50*** | (2006.01) |
| ***A47C 7/00*** | (2006.01) |
| ***A47C 7/40*** | (2006.01) |
| ***A47C 7/54*** | (2006.01) |

(52) U.S. Cl.
CPC ..... *A47C 7/62* (2013.01); *A47C 1/00* (2013.01); *A47C 3/18* (2013.01); *A47C 7/004* (2013.01); *A47C 7/006* (2013.01); *A47C 7/40* (2013.01); *A47C 7/506* (2013.01); *A47C 7/54* (2013.01)

(58) Field of Classification Search
CPC .... A47C 7/62; A47C 1/00; A47C 3/18; A47C 7/004; A47C 7/006; A47C 7/40; A47C 7/506; A47C 7/54
USPC ..... 297/423.19, 217.1, 217.3, 423.4
See application file for complete search history.

(56) References Cited

U.S. PATENT DOCUMENTS

| | | | | |
|---|---|---|---|---|
| 4,063,321 | A * | 12/1977 | Nichols | B63B 29/06 297/423.19 X |
| 7,125,074 | B2 | 10/2006 | Real et al. | |
| 8,251,452 | B2 | 8/2012 | Hill | |
| 8,298,845 | B2 | 10/2012 | Childress | |
| 8,794,698 | B2 | 8/2014 | Halsey | |
| 9,058,750 | B2 | 6/2015 | Bohlender | |
| 2009/0206641 | A1* | 8/2009 | Brown, Jr. | A47C 7/72 297/217.3 X |
| 2009/0218860 | A1* | 9/2009 | Hernandez | A47C 15/004 297/217.3 |
| 2011/0086747 | A1 | 4/2011 | Broderick | |

FOREIGN PATENT DOCUMENTS

| | | |
|---|---|---|
| WO | WO2006/119568 | 11/2006 |

* cited by examiner

*Primary Examiner* — Anthony D Barfield
(74) *Attorney, Agent, or Firm* — Edward M. Livingston, Esq.; Bryan L. Loeffler, Esq.; Livingston Loeffler, P.A.

(57) ABSTRACT

A gaming chair (1) used primarily for flight simulation and driving games having a rotatable wheeled base and a footrest secured to the front of the chair via lower mounting brackets that allow the chair and footrest to be rotated and moved as a single unit. Upper mounting brackets (20) are preferably secured directly to or adjacent to armrests (4, 5) of the gaming chair to provide a plurality of attachment points (17) for securing one or more upper support surfaces (21) that have mounting locations for additional peripherals.

18 Claims, 3 Drawing Sheets

GAMING CHAIR

FIELD OF THE INVENTION

This invention relates to peripherals and accessories for video games and more particularly a gaming chair that enhances a user's entertainment and gaming experiences playing flight simulator games and driving games.

BACKGROUND OF THE INVENTION

Video games are played both on personal computers and on video game consoles. A genre of video games that are particularly popular are flight simulator and driving games. Most flight simulator and driving games may be played with conventional joysticks and/or keyboards from a desk chair or couch. However, players of flight simulator and driving games often desire a more authentic experience while playing and, thus, purchase peripheral user input devices, such as throttle assemblies, joystick assemblies and/or foot-pedal assemblies. These peripherals are designed to be secured to a table top or to the floor as is the case with foot pedals. Accordingly, a user will typically position a chair and a table in front of his/her monitor or television, and position the peripherals accordingly. Of course this configuration and placement of the peripherals does not mimic an actual cockpit chair or driver's seat and/or allow the user to configure the chair to his or her specifications by adjusting the size of the chair and/or interchanging the peripherals.

Therefore, a need exists for a gaming chair that enhances a user's entertainment and gaming experiences by providing mounting locations for peripherals commonly used in flight simulator and driving video games and provides size adjustability.

The relevant prior art includes the following references:

| Pat. No. | Inventor | Issue/Publication Date |
|---|---|---|
| (U.S. Patent References) | | |
| 7,125,074 | Real et al. | Oct. 24, 2006 |
| 2011/0086747 | Broderick | Apr. 14, 2011 |
| 8,251,452 | Hill | Aug. 28, 2012 |
| 8,298,845 | Childress | Oct. 30, 2012 |
| 8,794,698 | Halsey | Aug. 5, 2014 |
| 9,058,750 | Bohlender | Jun. 16, 2015 |
| (Foreign Patent References) | | |
| W02006/119568 | James-Herbert | Nov. 16, 2006 |

SUMMARY OF THE INVENTION

The primary object of the present invention is to provide a gaming chair that enhances a user's entertainment and gaming experiences by providing mounting locations for peripherals commonly used in flight simulator and driving video games and providing size adjustability.

The present invention fulfills the above and other objects by providing a gaming chair used primarily for flight simulation and driving games having a rotatable wheeled base and a footrest secured to the front of the chair via lower mounting brackets that allow the chair and footrest to be rotated and moved as a single unit. The footrest is preferably adjustable to allow a user to shorten or lengthen the footrest in relation to the seat of the chair. The footrest may also be adjustable to allow the user to adjust the height of the foot rest in relation to the floor and the angle of the foot rest supports in relation to the seat of the chair.

Support surfaces extend from the arms of the chair to provide mounting locations for additional peripherals such as joysticks, throttles, keyboards and so forth. Upper mounting brackets secured to the arms of the chair or near the arms, allows a user to add multiple support surfaces as required and position the support surfaces in multiple configurations.

The upper mounting brackets also provide a location to mount power strips, USB hubs and so forth that provide mechanisms for organizing any USB cords or power cords from the peripherals into a single location, thereby significantly reducing any wire bundles that could become entangled while using the chair.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
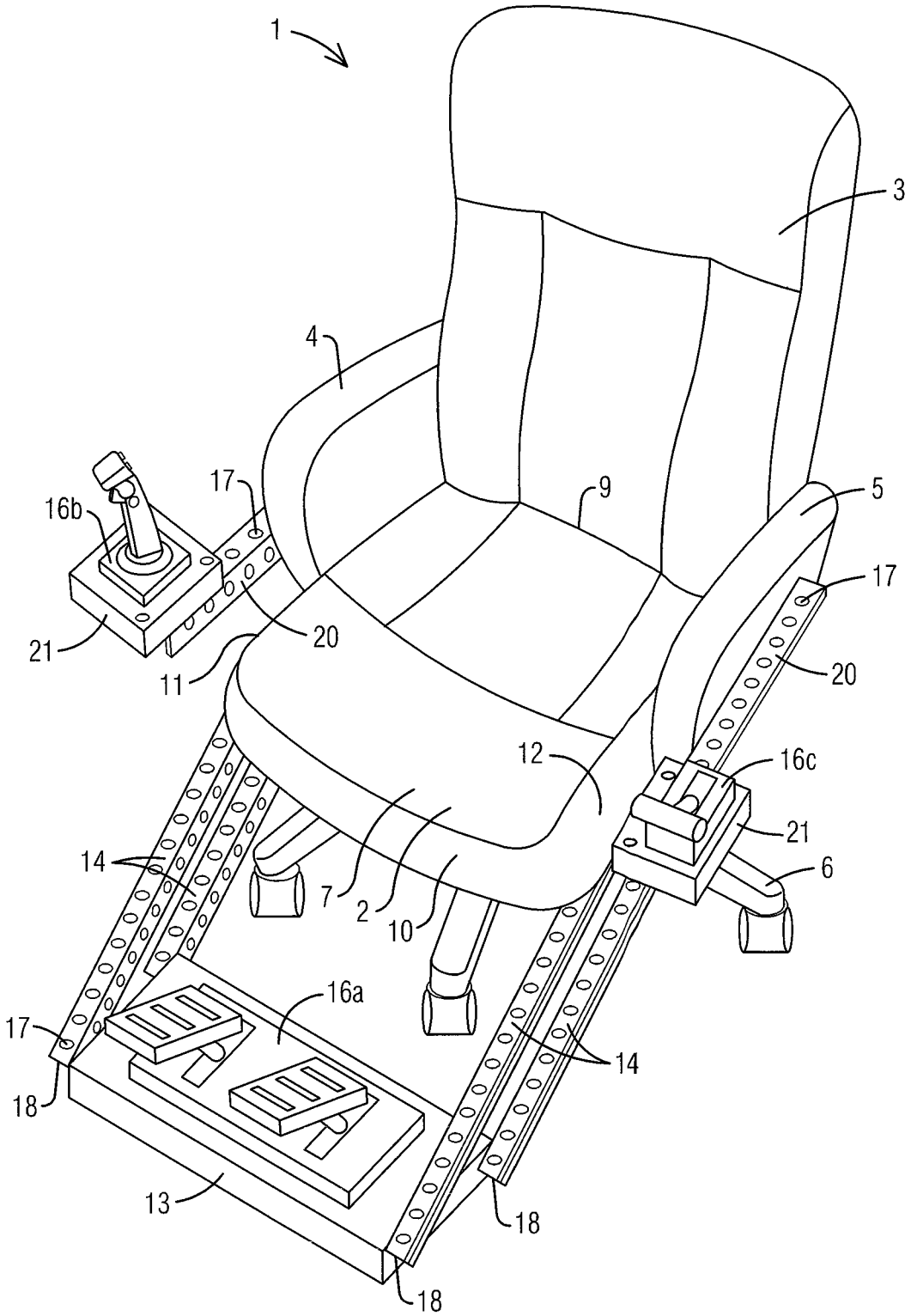
FIG. 1 is a perspective top side view of a gaming chair of the present invention.
Figure 2:
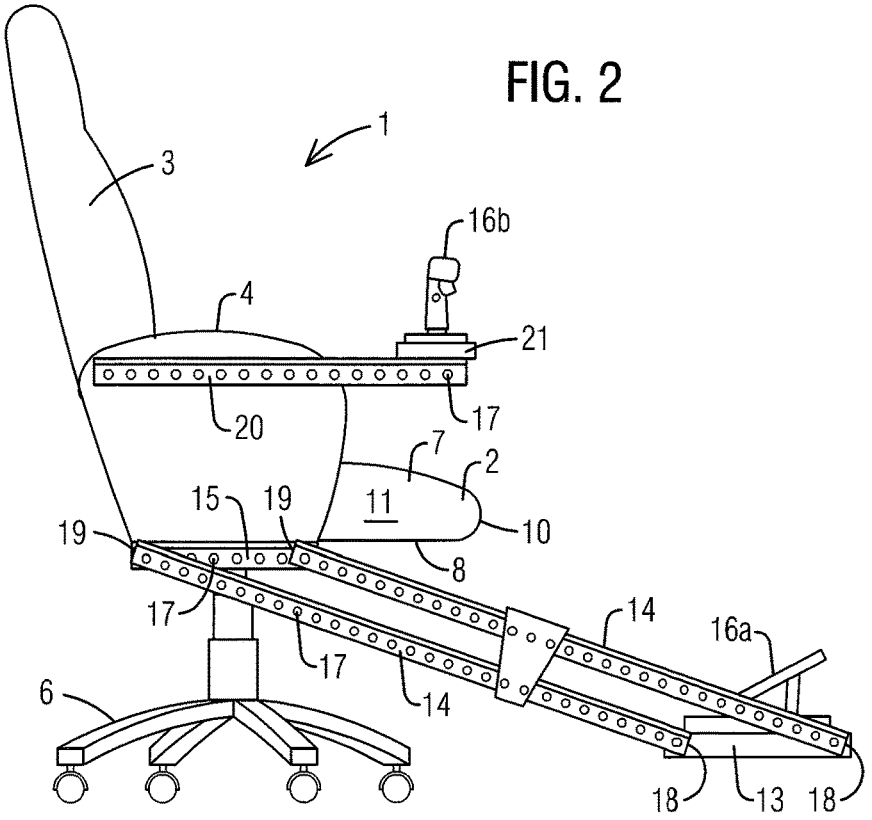
FIG. 2 is a right side view of a gaming chair of the present invention.
Figure 3:
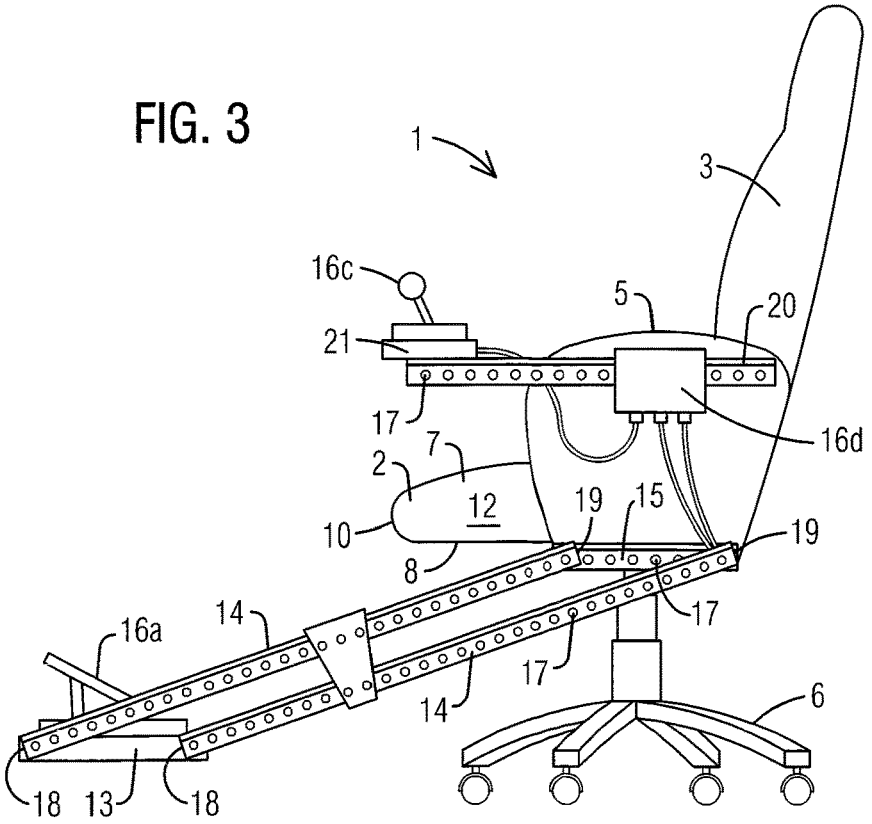
FIG. 3 is a left side view of a gaming chair of the present invention.
Figure 4:
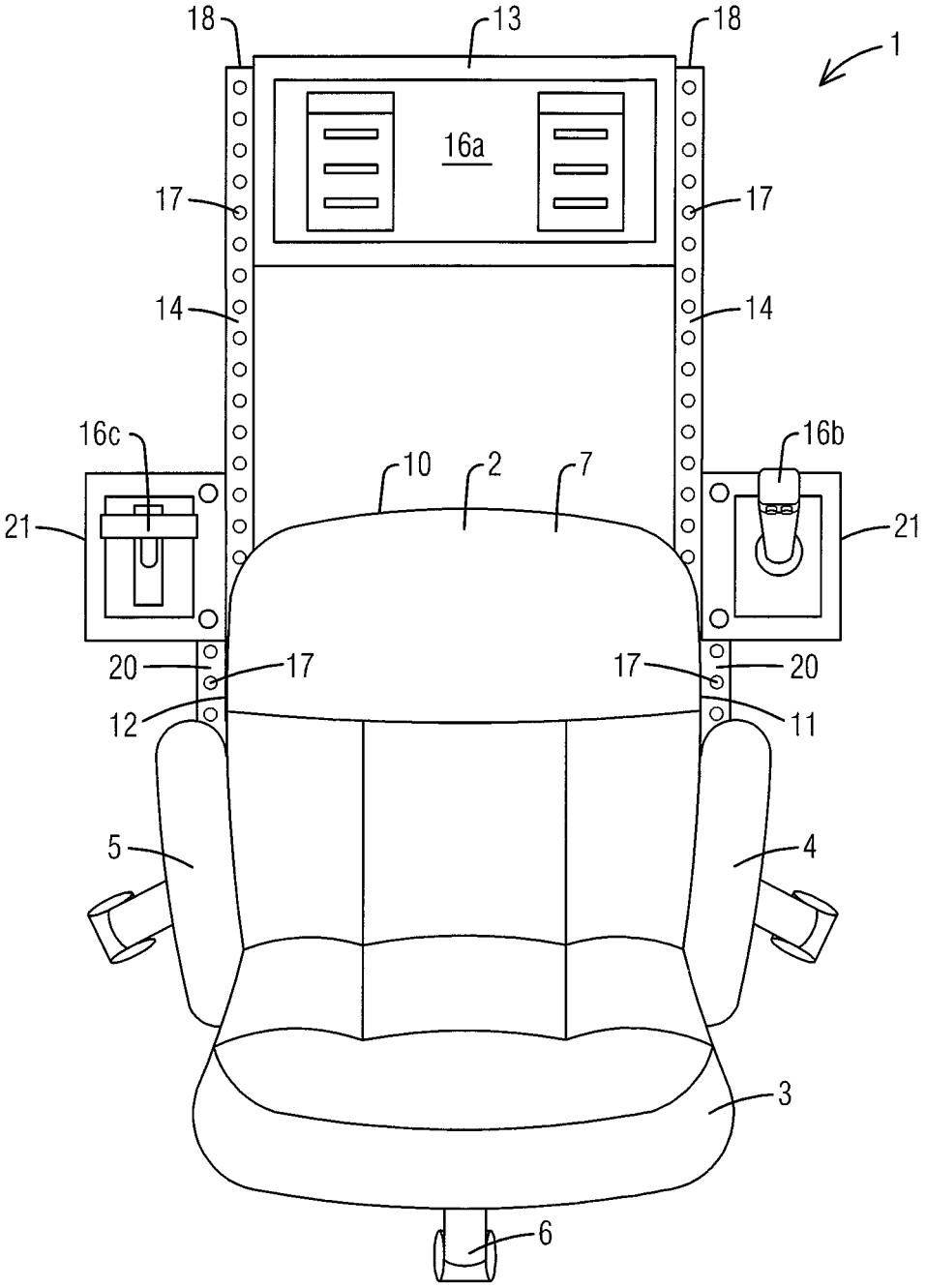
FIG. 4 is a top view of a gaming chair of the present invention.

For purposes of describing the preferred embodiment, the terminology used in reference to the numbered accessories in the drawings is as follows:

1. gaming chair, generally
2. seat support
3. back support
4. right arm rest
5. left arm rest
6. rotating wheeled base
7. top surface of seat support
8. bottom surface of seat support
9. rear edge of seat support
10. front edge of seat support
11. right side edge of seat support
12. left side edge of seat support
13. foot rest
14. elongated foot rest support
15. lower mounting bracket
16. peripheral
16*a*. pedals
16*b*. joystick
16*c*. throttle
16*d*. USB hub
17. attachment point
18. distal end of elongated foot rest support
19. proximal end of elongated foot rest support
20. upper mounting bracket
21. upper support surface With reference to FIGS. 1-5, the gaming chair 1 of the present invention comprises a seat support 2, a back support 3, a right arm rest 4, a left arm rest 5 and a rotating wheeled base 6 extending downward from the seat support 2. The seat support 2 further comprises a top surface 7, bottom surface 8, rear edge 9, front edge 10, right side edge 11 and left side edge 12.

A footrest 13 is supported by elongated foot rest supports 14 and lower mounting brackets 15. The footrest 13 provides a mounting surface for peripherals 16 such as pedals. The lower mounting brackets 15 are preferably secured to the bottom surface 8 of the seat support 2 adjacent to the right side edge 11 of the seat support 2 and left side edge 12 of the seat support 2, respectively. The lower mounting brackets 15 provide a plurality of attachment points 17 for securing the elongated foot rest supports 14 thereto. The lower mounting brackets 15 extend downward at a predetermined angle in relation to the front edge 10 of the seat support 2. The footrest 13, which is preferably a planar shaped panel, is secured to distal ends 18 of the elongated foot rest supports 14. The elongated foot rest supports 14 are preferably rotatably attached to the lower mounting brackets 15 and the footrest 13, respectively, to allow a user to adjust the angle of the elongated foot rest supports 14 in relation to the front edge 10 of the seat support 2, thereby making the elongated foot rest supports 14 height adjustable. The distance of the foot rest 13 in relation to the front edge 10 of the seat support 2 may also be adjusted by moving proximal ends 19 of the elongated foot rest supports 14 forward or backward on the lower mounting brackets 15 using the plurality of attachment points 17 on the lower mounting brackets 15, thereby making the elongated foot rest supports 14 length adjustable. Alternatively, the elongated foot rest supports 14 may be telescoping.

Upper mounting brackets 20 are preferably secured directly to or adjacent to the armrests 4, 5 of the gaming chair 1 and/or are integral to the arm rests or armrest supports. The upper mounting brackets 20 provide a plurality of attachment points 17 for securing one or more upper support surfaces 21 that extend from the armrests 4, 5 of the gaming chair 1 to provide mounting locations for additional peripherals 16 such as joysticks 16*b*, throttles 16*c*, keyboards and so forth. The plurality of attachment points 17 allow a user to add multiple upper support surfaces 21 as required and position the support surfaces 21 in multiple configurations surrounding the arm rests 4, 5.

The upper mounting brackets 20 may also extend around the back support 3 of the gaming chair 2 and provide a plurality of attachment points 17 for securing peripherals directly to the gaming chair 2 without the use of upper support surfaces 21, such as power strips, USB hubs 16*d* and so forth, that provide a mechanism for organizing any USB type cords and power cords from the peripherals 16 into a single location, thereby significantly reducing any wire bundles that could become entangled while using the gaming chair 2.

The lower mounting brackets 15 and upper mounting brackets 20 may be tubular-shaped, planar, L-shaped or so forth to provide locations for the plurality of attachment points 17, which as illustrated herein are apertures.

It is to be understood that while a preferred embodiment of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

Having thus described my invention, I claim:

1. A gaming chair comprising:

a seat support, a back support, a right arm rest, a left arm rest and a rotating wheeled base extending downward from the seat support;

said seat support having a top surface, a bottom surface, a rear edge, a front edge, a right side edge and a left side edge;

a footrest supported by at least one elongated foot rest support extending from the seat support;

at least one upper mounting bracket secured to the gaming chair in a position that is substantially parallel to the right arm rest and the left arm rest;

said at least one upper mounting bracket having a plurality of attachment points located thereon;

said plurality of attachment points being a plurality of apertures spaced apart along said at least one upper mounting bracket; and at least one upper support surface attached to the at least one upper mounting bracket via at least one attachment point of the plurality of attachment points located on the at least one upper mounting bracket.

2. The gaming chair of claim 1 further comprising:

at least one lower mounting bracket located on the bottom surface of the seat support to provide at least one attachment point for attaching the at least one elongated foot rest support to the gaming chair.

3. The gaming chair of claim 1 wherein:

said at least one upper mounting bracket is L-shaped.

4. The gaming chair of claim 2 wherein:

said at least one lower mounting bracket has a plurality of attachment points located thereon.

5. The gaining chair of claim 1 further comprising:

at least one peripheral attached to the at least one upper mounting bracket.

6. The gaming chair of claim 1 further comprising:

at least one peripheral attached to the foot rest.

7. The gaming chair of claim 1 further comprising:

at least one peripheral attached to the at least one upper support surface.

8. A gaming chair comprising:

a seat support, a back support, a right arm rest, a left arm rest and a rotating wheeled base extending downward from the seat support;

said seat support having a top surface, a bottom surface, a rear edge, a front edge, a right side edge and a left side edge;

a footrest supported by at least one elongated foot rest support extending from the seat support;

at least one upper mounting bracket secured to the gaming chair in a position that is substantially parallel to the right arm rest and the left arm rest;

said at least one upper mounting bracket having a plurality of attachment points located thereon;

said plurality of attachment points located on said at least one upper mounting bracket being a plurality of apertures spaced apart along said at least one upper mounting bracket;

at least one upper support surface attached to the at least one upper mounting bracket via at least one attachment point of the plurality of attachment points located on the at least one upper mounting bracket;

at least one lower mounting bracket located on the bottom surface of the seat support to provide at least one attachment point for attaching the at least one elongated foot rest support to the gaming chair;

said at least one lower mounting bracket having a plurality of attachment points located thereon; and said plurality of attachment points located on said at least one lower mounting bracket being a plurality of apertures spaced apart along said at least one upper mounting bracket.

9. The gaming chair of claim 8 wherein:

said at least one upper mounting bracket is L-shaped.

10. The gaming chair of claim 8 wherein:

said at least one lower mounting bracket is L-shaped.

11. The gaming chair of claim 8 further comprising:

at least one peripheral attached to the at least one upper mounting bracket.

12. The gaming chair of claim 8 further comprising:

at least one peripheral attached to the foot rest.

13. The gaming chair of claim 8 further comprising:

at least one peripheral attached to the at least one upper support surface.

14. A gaming chair comprising:

a seat support, a back support, a right arm rest, a left arm rest and a rotating wheeled base extending downward from the seat support;

said seat support having a top surface, a bottom surface, a rear edge, a front edge, a right side edge and a left side edge;

a footrest supported by at least one elongated foot rest support extending from the seat support;

at least one upper mounting bracket secured to the gaming chair in a position that is substantially parallel to the right arm rest and the left arm rest;

said at least one upper mounting bracket is L-shaped;

said at least one upper mounting bracket having a plurality of attachment points located thereon;

said plurality of attachment points located on said at least one upper mounting bracket being a plurality of apertures spaced apart along said at least one upper mounting bracket;

at least one upper support surface attached to the at least one upper mounting bracket via at least one attachment point of the plurality of attachment points located on the at least one upper mounting bracket;

at least one lower mounting bracket located on the bottom surface of the seat support to provide at least one attachment point for attaching the at least one elongated foot rest support to the gaining chair; and said at least one lower mounting bracket having a plurality of attachment points located thereon.

15. The gaining chair of claim 14 wherein:

said at least one lower mounting bracket is L-shaped.

16. The gaining chair of claim 14 further comprising:

at least one peripheral attached to the at least one upper mounting bracket.

17. The gaming chair of claim 14 further comprising:

at least one peripheral attached to the foot rest.

18. The gaming chair of claim 14 further comprising:

at least one peripheral attached to the at least one upper support surface.

* * * * *